United States Patent [19]

Pfeiffer et al.

[11] 4,404,832

[45] Sep. 20, 1983

[54] OPERATING A ROLLING MILL WORKING ON SEAMLESS TUBING

[75] Inventors: Gerd Pfeiffer; Horst Biller, both of Mülheim; Manfred Bellmann, Breitscheid; Karl Oberem, Mülheim; Alfred Lampe, Willich; Hermann-Josef Frentzen, Monchen-Gladbach, all of Fed. Rep. of Germany

[73] Assignee: Mannesmann Aktiengesellschaft, Düsseldorf, Fed. Rep. of Germany

[21] Appl. No.: 348,034

[22] Filed: Feb. 11, 1982

[30] Foreign Application Priority Data

Feb. 20, 1981 [JP] Japan ..... 54-24164

[51] Int. Cl.[3] ..... B21B 17/02

[52] U.S. Cl. ..... 72/209; 72/234; 72/370

[58] Field of Search ..... 72/96, 97, 208, 209, 72/234, 368, 370, 443

[56] References Cited

U.S. PATENT DOCUMENTS

| | | | |
|---|---|---|---|
| 3,552,170 | 1/1971 | Pfeiffer et al. | 72/209 |
| 4,289,011 | 9/1981 | Yoshiwara et al. | 72/208 |
| 4,353,238 | 10/1982 | Breton et al. | 72/209 |

FOREIGN PATENT DOCUMENTS

| | | |
|---|---|---|
| 1527608 | 2/1966 | Fed. Rep. of Germany . |
| 2345056 | 9/1973 | Fed. Rep. of Germany . |
| 2701824 | 1/1977 | Fed. Rep. of Germany . |

*Primary Examiner*—Francis S. Husar
*Assistant Examiner*—Jonathan L. Scherer
*Attorney, Agent, or Firm*—Ralf H. Siegemund

[57] ABSTRACT

It was discovered that a rolling mandrel holding a hollow which is rolled in a multistrand mill should be advanced in a particular manner that relates to the stretching the hollow undergoes in the first and second stand, as well as to the speed of the unrolled hollow. A velocity profile has been developed accordingly.

3 Claims, 1 Drawing Figure

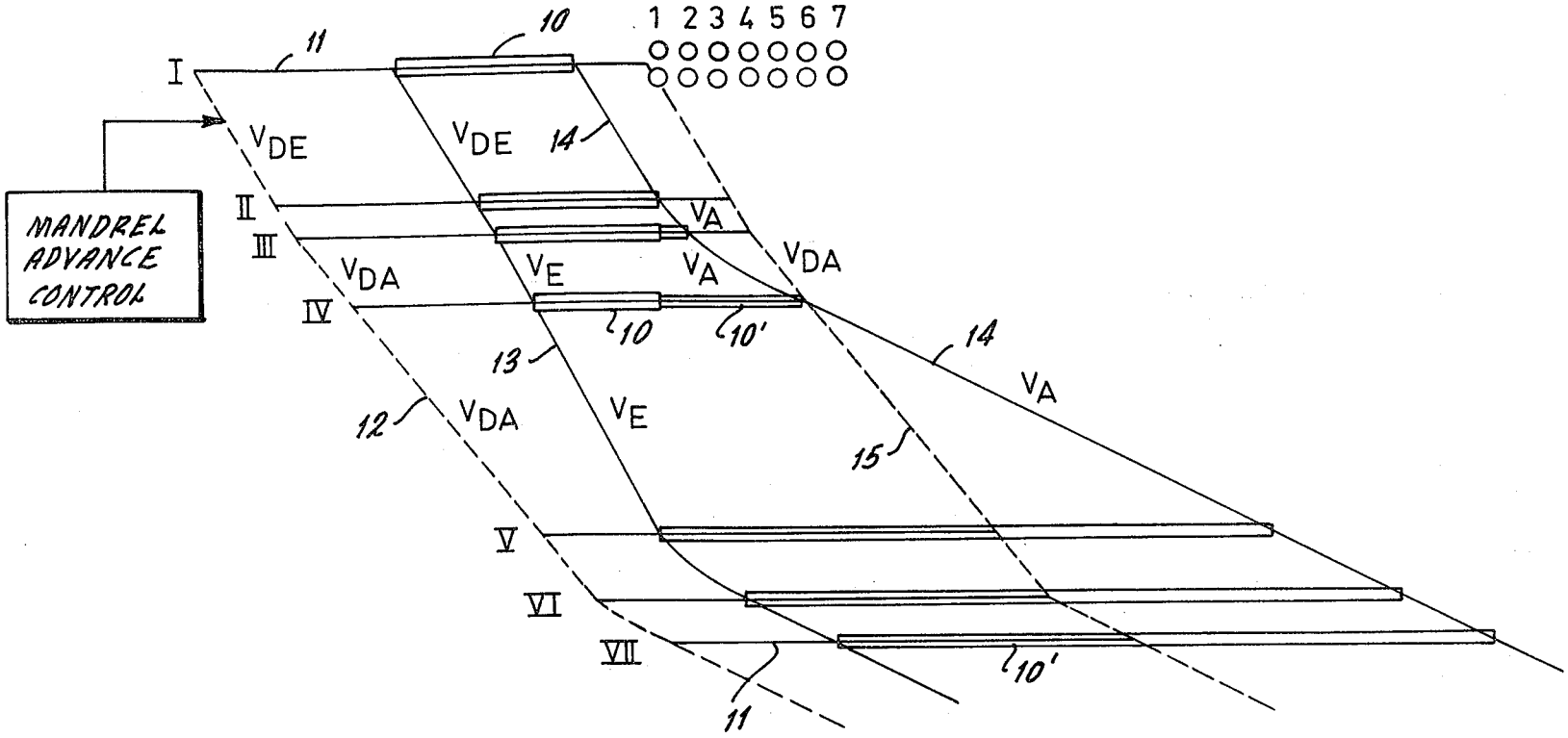
1 2 3 4 5 6 7
10
11
12
13
14
15
10'
$V_{DE}$
$V_{DA}$
$V_E$
$V_A$
I
II
III
IV
V
VI
VII
MANDREL ADVANCE CONTROL

OPERATING A ROLLING MILL WORKING ON SEAMLESS TUBING

BACKGROUND OF THE INVENTION

The present invention relates to the making of seamless tubes or pipes by means of driven hot rolls which are arranged in various frames, and under utilization of a long, cylindrical mandrel.

The German printed patent application No. 15 27 608 discloses such an arrangement, and it discloses further a method in which the mandrel undergoes particular motions during the rolling process. That motion (or, better, displacement) covers a span the length of which is considerably smaller than the length of the blank as well as the displacement of the blank. Advancing of the mandrel is particularly limited in that the mandrel is introduced in the beginning of rolling in order to extend up to the fourth the fifth or even the sixth rolling stand in a downstream direction of rolling. The mandrel is, thereafter, shifted just sufficiently to ensure full support of the rolled stock during subsequent passes.

The speed of advancement of the mandrel is quite low in the instance above. The mandrel is actually moved by the transmission of motion from the rolls via the stock around the mandrel. In fact, the rolls transmit a considerable tension force upon the mandrel whose forward motion on account of that force must be retarded. The German printed patent application No. 15 27 608 refers specifically to these forces, the transmission of which is due to high friction between the tubular or hollow blank and the mandrel.

Following the completion of rolling, the mandrel rod must be retracted so that the next hollow can be rolled. The retraction of the mandrel and, possibly, an exchange for another one is a part of the rolling cycle and, in some fashion, enters into the overall consideration of power consumption. Moreover, this known method requires that additional steps be taken to avoid breakdown and other interferences. For instance, the mandrel must be supported in between the various rolling stands as long as the rolled stock does not support the mandrel. Also, the flow of cooling water has to be stopped after rolling, up to rolling of the next hollow blank. This is necessary in order to avoid washing off the lubrication layer from that portion of the mandrel that has entered the stands and frames. Turning off the coolant flow after rolling is also required in order to avoid a thermoshock of the freshly exposed mandrel which, at that point, has attained a temperature of approximately 970° Kelvin. Such a thermoshock can readily lead to cracking of the mandrel.

The German printed patent application No. 23 45 056 deals with the problem resulting from relative motion between the blank and the mandrel during rolling. That motion heats the mandrel and wears it out. This particular reference is concerned with the making of seamless tubing in cooperation with a push bench, i.e., a continuous rolling mill with stands that are not driven. The deformation process of the material is different here from the case of a mill having driven stands. The front or leading end of the mandrel rod traverses two stand spacings in the same time span which the front end of the blank requires in order to arrive at the last one of eight stands after the end of the hollow has entered the last roll stand. This will result in an advance of the mandrel rod at a rate which is approximately 15% of the exit speed of the tube and, thus, reduces the wear of the mandrel rod.

In the case of a continuous rolling mill, having driven stands, the rate of progression of the mandrel is lower, e.g., in the order of 5% to 10% of the speed of the tube, assuming that seamless tubes are rolled on a mandrel having a length that is approximately 5% to 10% of the length of the rolled tube. German printed patent application No. 27 01 824 describes this method of working, particularly for improving the quality of the tube and for increasing the life of the mandrel.

Contrary to the earlier described method as per German printed patent application No. 15 27 608, having a vary low-controlled mandrel speed, the continuous method does not stop and hold the mandrel at any time during rolling so that the mandrel speed during rolling adapts to the different conditions during entering and exiting of the stock. This results in a unequal material flow which, in turn, requires additional expenditure in electronic and electric control equipment in order to ensure an adequate quality of the product within prescribed tolerances.

Applying the continuous method to the rolling of longer pipes of larger diameter encounters, as a restriction, an unfavorable ratio of blank length to length of the mandrel rod. The length of the mandrel rod is limited by restraints on manufacturing and is ultimately determined by the value of the force for stripping a thin tube. Free-running mandrels have a length close to the stripping length.

DESCRIPTION OF THE INVENTION

It is an object of the present invention to improve the hot-rolling of seamless hollows avoiding drawbacks and deficiencies outlined above while increasing quality and throughput under simplification of the rolling mill such as reduction in holding forces.

It is a specific object and feature of the present invention to improve a method of hot-rolling seamless hollows under utilization of a plurality of driven rolling stands cooperating with a long, cylindrical mandrel.

It is a feature of the present invention to control the mandrel advance in dependency upon the (absolute) rate of advance of the hollow to be rolled under consideration of the distribution of stretching produced by and in the mill.

In accordance with the preferred embodiment of the present invention, it is suggested to improve the method as per the specific object by particularly controlling the mandrel speed during rolling. At first, one determines the stretching $\lambda_n$ provided by and in the various roll stands, which parameters are directly available from the pass values in each stand and the mandrel speed during most of the rolling is now selected to be larger than $\lambda_1 \cdot V_E$ but smaller than $V_E[1+\lambda_1(2+\lambda_2)]/4$, wherein $V_E$ is the (absolute) velocity of the hollow to be (or that portion that is not yet) rolled while $\lambda_1$ and $\lambda_2$ are the stretch values in the first and second stands. Preferably, the mandrel speed is held initially to a value larger than 1.1 $V_E$ but smaller than $V_E(1+\lambda_1)/2$ until the front end of the hollow has passed the second stand. Thereafter, the first-mentioned range is to be observed. Moreover, the mandrel should be released (not held nor driven) after the rear end of the hollow has passed about more than half of the stands.

As far as most of the rolling pass is concerned, the speed value as per the first-mentioned rule is an optimized value in order to fulfill the following conditions.

The mandrel speed should be as small as possible because a low value favors a ratio of the length of the hollow to the mandrel length so as to make the mandrel as small as practical from a manufacturing point of view. Also, the strip length is minimized.

On the other hand, the mandrel speed must be sufficiently large so that the relative speed between the mandrel and the rolled material in the main-rolling stands does not exceed 2 meters per second. This way, heating of the mandrel surface on account of friction is considerably reduced as compared to the method which, in turn, increases the life of the mandrel to a considerable extent.

The mandrel speed must (always) exceed the entrance speed of the hollow into the first stand in order to avoid buildup and backup of scale. Such scale accumulation produces so-called scale holes on the inside of the tubing which is to be avoided. Finally, the mandrel speed must also exceed the exit speed of the rear end of the hollow when emerging from the first stand so that the first stand acts as a brake and that, in turn, relieves the mandrel drive.

The rule as per another feature of the invention and concerning the initial phases of rolling up to the time the hollow enters the second stand has the following added advantages. By keeping the mandrel speed above the speed of the hollow (more than 10% over that latter value) enhances the conditions under which the rolls, particularly the small and turned ones, grip the hollow. By keeping the mandrel speed below the average flow speed of the material in the first stand so that, indeed, the mandrel drive will act as a brake as soon as the first stand rolls engage the hollow so that further load changes on the mandrel drive are avoided.

In view of these steps and, particularly, the rules for controlling the advance of the mandrel, the relative speed between hollow and mandrel in the main-rolling stands does not exceed 2 meters per second.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

The FIGURE is a schematic process diagram demonstrating how the preferred embodiment of the present invention can be practiced in a best-mode configuration and sequence.

The FIGURE shows schematically seven roll stands, 1 through 7, in which a tubular blank 10 is rolled into a longer tube 10$^1$ of reduced diameter. Reference numeral 11 refers to the mandrel. The Roman numerals I through VII denote different instances in the rolling process; and one may say that time is referenced in the vertical and downward with respect to progression.

The dotted line 12 denotes the progression of the rear end of the mandrel. The slope of that dotted line 12 denotes the mandrel speed, wherein a steeper slope represents a smaller speed (time is taken in downward direction). Speed values $V_{DE}$ and $V_{DA}$ ($V_{DA}>V_{DE}$) will be explained below.

The solid line 13 denotes the progression of the rear end of the hollow blank; solid line 14 denotes the progression of the front end of the blank (10) at first and of the rolled tube (10$^1$) later; and the dashed line 15 denotes the progression of the front end of the mandrel. By necessity, lines 12 and 15 have the same distance (in the horizontal) throughout because the mandrel does not change in length. The distance relation among the lines 13 and 14, among themselves and to the other lines, is more complex. It should be noted that the mandrel control provides primarily for controlled retardation of advance of the mandrel 11 after the rolls have engaged the hollow blank.

Instance I denotes the beginning of a pass, the front end of mandrel 11 is about to enter the first stand, No. 1. The blank 10 is positioned somewhat upstream on mandrel 11, and both of them have, by necessity, the same speed, being the initial mandrel advance speed $V_{DE}$. The transition period from step I to II advances the mandrel through stands No. 1, 2, and 3, and instance II denotes the beginning of rolling, the front end of the blank 10 has reached the first stand, No. 1. At that instant, the speed of blank 10 is reduced to $V_E$, mandrel 11 continues at speed $V_{DE}$. As stated above, the mandrel speed $V_{DE}$ is at that point at least 10% above the speed $V_E$ of the unrolled hollow 10. However, the mandrel speed $V_{DE}$ is held to a value below $V_E(1+\lambda_1)/2$, wherein $\lambda_1$ is the relative stretching of the blank material in the first stand No. 1.

Instance III denotes the beginning of rolling the front end of the blank in stand No. 2, and the kink in lines 12 and 15 is indicative of an increase in mandrel speed from $V_{DE}$ to $V_{DA}$. Due to rolling, the front end of the rolled tube 10$^1$ increases in the $V_A$-speed, the rear end speed $V_E$ is reduced further.

The mandrel speed is now permitted to increase, i.e., $V_{DA}>V_{DE}$. Particularly, the mandrel speed is $\lambda_1$ times the speed of the hollow ($V_E$); but $V_{DA}$ is held to a value of below $V_E[1+\lambda_1(2+\lambda_2)]/4$, wherein $\lambda_2$ is the relative stretching provided by stand No. 2.

Instance IV denotes the position crossover when the front end of the tube passes over the front end of the mandrel. Instance V denotes the situation when the rear end of the blank has arrived at the first stand, No. 1. In instance VI, that rear end of the blank passes stand No. 4, and now the mandrel is released and assumes a speed imparted upon it by the rolling process. In instance VII, the rolled tube leaves stand No. 7.

Release of the mandrel after the hollow has passed more than half the stands (i.e., stand No. 4) permits the mandrel to propagate with the rolled tube; and afterwards the mandrel is pulled out of the tube in a manner known per se from continuous-type rolling mills. This particular mode of release is a factor in the selection of the mandrel length. If the mandrel was released when the rear of the hollow has just passed the first stand the requisite mandrel length would be at a minimum, while a release after the rear of the hollow has passed the last stand (No. 7) the length requirement for the mandrel will be the largest. Off hand, release after passage of the hollow through stand No. 1 appears to be desirable, but this requires additional control due to unequal material flow. If, however, the release is deferred until the hollow has passed half of the stands or more, this control can be dispensed with and the required mandrel length is still well below the maximum needed when the release is deferred until after completion of rolling. Early release of the mandrel permits directly a reduction in cycle time as compared with a method requiring mandrel retraction and a correspondingly higher power requirement.

After completion of rolling, the tubes are stripped off the mandrel and finished or otherwise processed, such as in a stretch-reducing mill and/or a sizing mill.

The invention is not limited to the embodiments described above; but all changes and modifications thereof, not constituting departures from the spirit and scope of the invention, are intended to be included.

We claim:

1. In a method of hot-rolling seamless hollows by means of a plurality of driven roll stands under utilization of an elongated cylindrical mandrel, comprising the steps of determining stretch values of at least a first one and a second one of said stands, $\lambda_1$ and $\lambda_2$; and controlling the mandrel speed during rolling to be larger than $\lambda_1 \cdot V_E$ but smaller than $V_E[1+\lambda_1(2+\lambda_2)]/4$, wherein $V_E$ is the actual entrance speed of the hollow at the first stand and upstream thereof.

2. A method as in claim 1, comprising the additional step of moving the mandrel at a speed, until the front end of the hollow has passed the second stand, said speed being larger than $1.1 \cdot V_E$ but smaller than $V_E(1+\lambda_1)/2$.

3. A method as in claim 1 or 2, comprising in addition the step of releasing the mandrel after the rear end of the hollow has passed more than half the number of stands.

* * * * *